US006931758B2

(12) United States Patent
Sakamoto et al.

(10) Patent No.: US 6,931,758 B2
(45) Date of Patent: Aug. 23, 2005

(54) METHOD OF CONTROLLING MOISTURE OF MATERIAL AND APPARATUS THEREFORE

(75) Inventors: Koji Sakamoto, Hiratsuka (JP); Susumu Uchida, Hiratsuka (JP); Katsuhide Yokota, Hiratsuka (JP); Takashi Ogawa, Hiratsuka (JP); Kazuo Yoshimoto, Hiratsuka (JP)

(73) Assignee: Japan Tobacco, Inc., Tokyo (JP)

( * ) Notice: Subject to any disclaimer, the term of this patent is extended or adjusted under 35 U.S.C. 154(b) by 0 days.

(21) Appl. No.: 10/923,032

(22) Filed: Aug. 23, 2004

(65) Prior Publication Data

US 2005/0034321 A1 Feb. 17, 2005

Related U.S. Application Data

(63) Continuation of application No. PCT/JP03/03019, filed on Mar. 13, 2003.

(30) Foreign Application Priority Data

Mar. 14, 2002 (JP) ..... 2002-069856

(51) Int. Cl.[7] ..... F26B 3/08

(52) U.S. Cl. ..... 34/369; 34/137; 34/557

(58) Field of Search ..... 34/363, 369, 474, 34/135, 137, 557; 366/151.1; 131/305

(56) References Cited

U.S. PATENT DOCUMENTS

| | | | | | |
|---|---|---|---|---|---|
| 3,409,025 | A | * | 11/1968 | Wochnowski | 131/303 |
| 3,905,123 | A | * | 9/1975 | Fowler et al. | 34/484 |
| 3,906,961 | A | * | 9/1975 | Rowell et al. | 131/303 |
| 4,102,349 | A | * | 7/1978 | Psaras et al. | 131/303 |
| 4,984,374 | A | * | 1/1991 | Bird et al. | 34/557 |
| 5,103,842 | A | * | 4/1992 | Strang et al. | 131/303 |
| 5,538,747 | A | * | 7/1996 | Mueller | 426/507 |
| 5,964,225 | A | * | 10/1999 | Blackwell et al. | 131/305 |
| 6,286,515 | B1 | * | 9/2001 | Wagoner | 131/305 |

FOREIGN PATENT DOCUMENTS

| | | | |
|---|---|---|---|
| JP | 6-209751 | A | 8/1994 |
| JP | 7-177870 | A | 7/1995 |
| JP | 7-289226 | A | 11/1995 |
| JP | 2001-514023 | A | 9/2001 |
| WO | WO-01/60186 | A1 | 8/2001 |

* cited by examiner

*Primary Examiner*—Stephen Gravini
(74) *Attorney, Agent, or Firm*—Birch, Stewart, Kolasch & Birch, LLP

(57) ABSTRACT

An apparatus for carrying out a method of controlling the moisture of tobacco material comprises a hollow rotating cylinder (6) having an inlet (4) and an outlet (8) for tobacco material, and a feeding device for supplying a moist air flow into the rotating cylinder (6) such that the moist air flow runs out from the inlet (4) toward the outlet (8) within the rotating cylinder (6). Temperature and relative humidity of the moist air flow supplied into the rotating cylinder (6) are within the range of 40–80° C. and 80–95%, respectively.

12 Claims, 5 Drawing Sheets

METHOD OF CONTROLLING MOISTURE OF MATERIAL AND APPARATUS THEREFORE

This application is a Continuation of co-pending PCT International Application No. PCT/JP03/03019 filed on Mar. 13, 2003, which designated the United States, and on which priority is claimed under 35 U.S.C. §120, which claims priority under 35 U.S.C. §119(a) on Patent Application No(s). 2002-069856 filed in Japan on Mar. 14, 2002, the entire contents of which are hereby incorporated by reference.

TECHNICAL FIELD

The present invention relates to a method of controlling moisture of material and an apparatus therefor, in particular, a method and an apparatus suitable for tobacco material.

BACKGROUND ART

Moisture control apparatuses for tobacco material are disclosed in for example Japanese Translation of PCT International Application No. 2001-514023 and International Publication No. WO 01/60186 A1. These well-known moisture control apparatuses are both provided with a rotating cylinder, and tobacco material fed into the rotating cylinder is transferred in the rotating cylinder while being stirred. In this transferring process, water is sprayed toward the tobacco material, thereby controlling the moisture content of the tobacco material.

With such moisture control of tobacco material, however, water cannot be evenly sprinkled on the surface of the tobacco material. Thus, variation tends to generate in the percentage of water content of the tobacco material. The variation in the percentage of water content (uneven moisture control) causes the fracture of the tobacco material when the tobacco material is stirred in the transferring process. This produces fine fragments of the material, which are unsuitable as filling materials for cigarettes, and increases material loss.

Furthermore, the uneven moisture control not only deteriorates the original aroma of tobacco material but also has a damaging effect on the subsequent flavoring process.

Unexamined Japanese Patent Publication No. 6-209751 discloses a moisture control method and an apparatus therefor in which tobacco material is brought into contact with moist air in the process of transferring the tobacco material on a mesh belt. According to such a moisture control method, the tobacco material is not stirred, preventing the fracture thereof. The moist air mentioned in the above publication, however, has the relative humidity close to equilibrium with respect to the moisture content of the tobacco material, so that it takes considerable time to carry out the even moisture control of the tobacco material. Consequently, the invention disclosed in the publication is not suitable for the moisture treatment of a large quantity of tobacco material.

DISCLOSURE OF THE INVENTION

An object of the present invention is to provide a moisture control method and an apparatus capable of not only processing a large quantity of material but also controlling moisture of the material evenly.

In order to accomplish the above object, the moisture control method according to the present invention comprises the steps of transferring material along a given transfer path while stirring the material, and causing moist air, which is heated to a given temperature and has relative humidity close to a saturated vapor pressure, to flow along the transfer path in a process of transferring the material, to thereby bring the material into contact with the moist air flow.

According to the above-described moisture control method, since the material is transferred while being stirred, an entire surface of the material is maintained in constant contact with the moist air flow. Thus, the material can efficiently absorb moisture contained in the moist air flow from the entire surface thereof.

It is preferable that the moist air flow have a relative humidity of from 80 to 95%. Although such a moist air flow contains high moisture content, water droplets do not adhere onto the surface of the material. Therefore, the surface of the material does not get wet with water, and the material can efficiently absorb moisture contained in the moist air flow from the entire surface through to the inside. As a result, the total percentage of water content of the material becomes even in a short period of time, making it possible to subject a great quantity of material to a rapid moisture-controlling process.

When the material absorbs moisture, there generates heat of absorption, which evenly heats the material.

In a case that the material is tobacco material, it is desirable that the moist air flow have a heating temperature of from 40 to 80° C. With such a moist air flow, even if the moist air flow contacts the tobacco material, there is no fear that the tobacco material is overheated, and the original aroma of the tobacco material is not deteriorated by heat. Moreover, the rapid and even moisture control of the tobacco material suppresses fracture of the tobacco material even if the tobacco material is stirred, which enables reductions in material loss.

The moist air flow preferably circulates in the transfer path. This makes it possible to reuse the moist air.

The moisture control apparatus for carrying out the above-described moisture control method comprises a hollow rotating cylinder having an inlet for material at one end thereof and an outlet for the material at the other end thereof and transferring the material supplied through the inlet to the outlet while stirring the material when the rotating cylinder is rotated, and a feeding device for supplying a moist air flow heated to a given temperature and close to a saturated vapor pressure into the rotating cylinder, the feeding device having an air-supply opening located at one end of the rotating cylinder and a discharge opening located at the other end of the rotating cylinder and causing the moist air flow to run out from the air-supply opening toward the discharge opening.

In this case, the feeding device further comprises a circulation system for circulating the moist air flow through the inside of the rotating cylinder, the circulation system having a circulation conduit extended outside the rotating cylinder to connect the air-supply opening and the discharge opening. The inlet and the outlet include respective rotary valves, which each allow the material to be either supplied into or discharged from the rotating cylinder and also prevent the moist air flow from leaking out from the inlet and the outlet.

Since the rotary valves prevent loss of the moist air, reusability of the moist air is heightened, which enables the continuous treatment of the material within the rotating cylinder.

Specifically, the circulation system further includes an air blower, a heater and a humidifier arranged in the circulation conduit in the order named from the discharge opening side.

The air blower produces an air flow heading for the rotating cylinder, and the heater heats the air flow to a given temperature. The humidifier moistens the heated air flow.

In this case, the circulation system further may have control means for controlling operation of the air blower, heater and humidifier.

The feeding device may be further provided with an intermediate air-supply opening in the rotating cylinder, from which the moist air flow runs out. The intermediate air-supply opening is located in between the air-supply opening and the outlet in view of an axial direction of the rotating cylinder.

In this case, the moist air flow is supplied both from the air-supply opening and the intermediate air-supply opening into the rotating cylinder, which not only assures a moist air flow amount required for the material moisture control without difficulty but also creates a moist air flow suitable for the material moisture control in the rotating cylinder.

Specifically, the intermediate air-supply opening is either located on the axis of the rotating cylinder or formed into an annulus extending along a circumferential wall of the rotating cylinder.

The annular intermediate air-supply opening can be readily obtained by using a split-type rotating cylinder. More specifically, the split-type rotating cylinder comprises an upstream-side cylinder portion including the inlet and a downstream-side cylinder portion including the outlet and having a larger diameter than the upstream-side cylinder. The annular intermediate air-supply opening is defined in between an outer peripheral surface of the upstream-side cylinder portion and an inner peripheral surface of the downstream-side cylinder portion.

BEST MODE OF CARRYING OUT THE INVENTION

Figure 1:
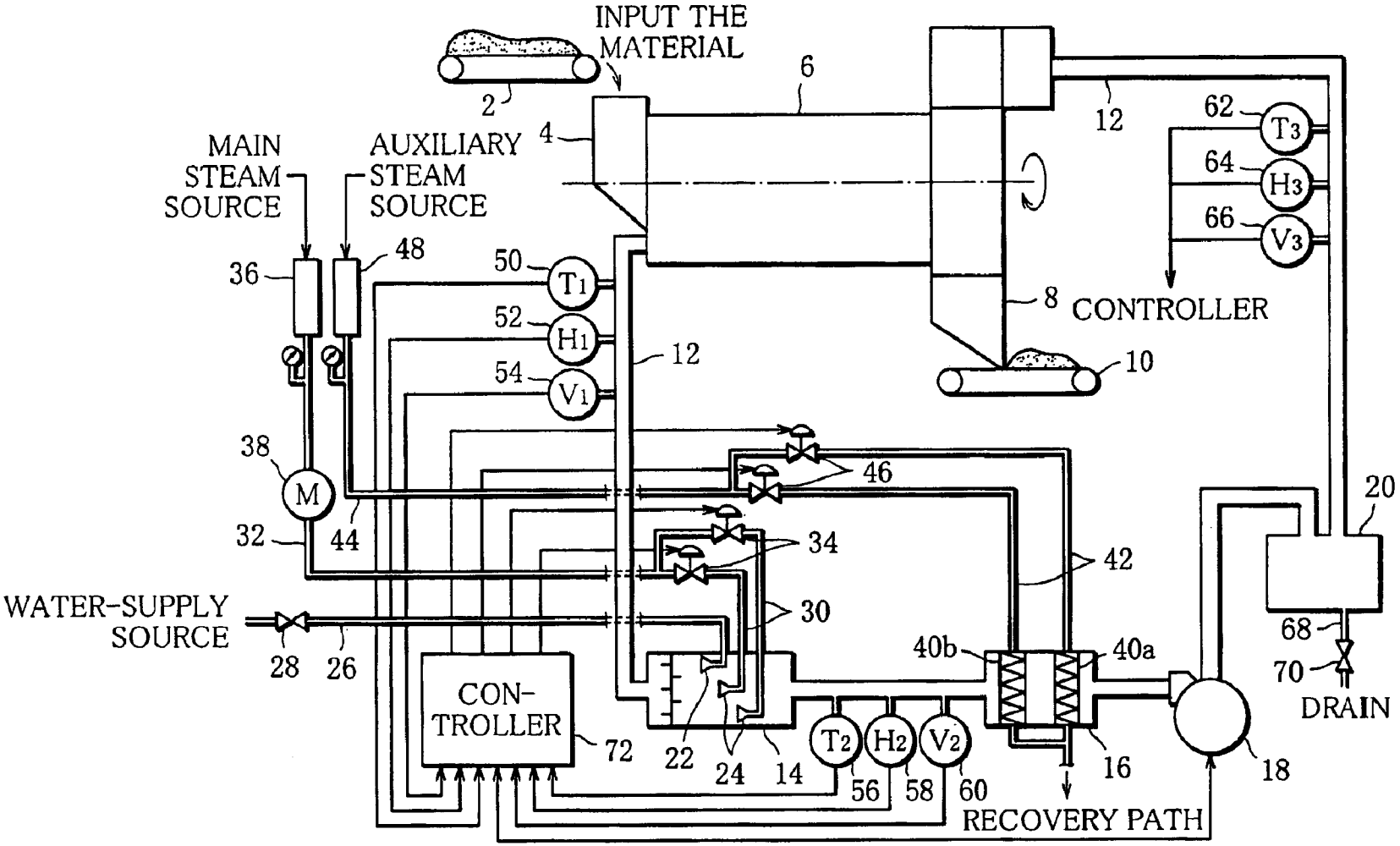
FIG. 1 is a schematic view showing an entire moisture control apparatus according to one embodiment.

FIG. 1 shows a moisture control apparatus applied for tobacco material.

The tobacco material includes any one of tobacco leaves, midribs of tobacco leaves, sheet-like reconstructed tobacco, shred tobacco obtained by shredding the above items and shred tobacco subjected to an expanding process or includes a mixture of two or more of the above items. Hereinafter, the tobacco material is simply referred to as material.

The moisture control apparatus comprises a conveyer 2 of a volumetric material feeding type. There is disposed a hollow rotating cylinder 6 below the conveyer 2, the rotating cylinder 6 having an inlet 4 of the material at one end thereof and an outlet 8 at the other end thereof. The conveyer 2 transfers the material toward the rotating cylinder 6 to supply the material into the rotating cylinder 6 through the inlet 4.

As described later, the rotating cylinder 6 is rotated in one direction, and with the rotation, the material in the rotating cylinder 6 is transferred from the one end toward the other end in an axial direction of the rotating cylinder 6 and discharged from the outlet 8 onto a discharge conveyer 10.

Extending from the one end of the rotating cylinder 6 is a circulation path 12 for moist air, the circulation conduit 12 being connected to the other end of the rotating cylinder 6. The circulation conduit 12 defines a circulation path of the moist air with a cylinder chamber of the rotating cylinder 6.

In the circulation conduit 12, there are disposed a humidifier 14, a steam heater 16, an electric air blower 18 of an inverter type and a recovery tank 20 in the order named from the inlet 4 side of the rotating cylinder 6.

Arranged in the humidifier 14 are a plurality of water-supply nozzles 22 and a plurality of steam nozzles 24 together with a stirring vane and a steam trap. The water-supply nozzles 22 are connected through a water-supply pipe 26 to a water-supply source, and an open/close valve 28 is disposed in the water-supply pipe 26. FIG. 1 shows only one water-supply nozzle 22 and two steam nozzles 24.

Connected to each of the steam nozzles 24 is a branch pipe 30, which is connected to a steam pipe 32. Each branch pipe 30 is provided with a flow control valve 34 of an electromagnetic operation type. The steam pipe 32 is connected to a main steam source via a pressure-reducing valve 36 and provided with a flowmeter 38 therein.

The steam heater 16 has two heat exchangers 40*a* and 40*b* built-in. Branch pipes 42 extend from the respective heat exchangers 40 and are connected to a steam pipe 44. A flow control valve 46 of an electromagnetic operation type is arranged in each branch pipe 42. The steam pipe 44 is connected to an auxiliary steam source via a pressure-reducing valve 48. Each heat exchanger 40 is connected to a recovery path through a pipe.

The circulation conduit 12 comprises an inlet temperature indicator 50, an inlet humidity indicator 52 and an inlet velocity indicator 54 arranged in between the rotating cylinder 6 and the humidifier 14. The temperature indicator 50, the humidity indicator 52 and the velocity indicator 54 detect inlet temperature $T_1$, inlet humidity $H_1$ and inlet velocity $V_1$ of the moist air flow which runs into the rotating cylinder 6, respectively. The circulation conduit 12 has an intermediate temperature indicator 56, an intermediate humidity indicator 58 and an intermediate velocity indicator 60 located in between the humidifier 14 and the steam heater 16. The temperature indicator 56, the humidity indicator 58 and the velocity indicator 60 detect intermediate temperature $T_2$, intermediate humidity $H_2$ and intermediate velocity $V_2$ of the moist air which flows into the humidifier 14, respectively. The circulation conduit 12 further includes an outlet temperature indicator 62, an outlet humidity indicator 64 and an outlet velocity indicator 66 disposed in between the recovery tank 20 and the rotating cylinder 6. The temperature indicator 62, the humidity indicator 64 and the velocity indicator 66 detect outlet temperature $T_3$, outlet humidity $H_3$ and outlet velocity $V_3$ of the moist air flow which has passed through the rotating cylinder 6, respectively. A drain pipe 68 extends from the recovery tank 20 and is provided with an open/close valve 70.

Once the air blower 18 is activated, air is supplied from the discharge opening of the air blower 18 into the circulation conduit 12, thereby producing an air flow in the circulation conduit 12. The air flow proceeds through an upstream-side portion of the circulation conduit 12 to the rotating cylinder 6 to pass through the rotating cylinder 6. Thereafter, the air flow returns from the rotating cylinder 6 through a downstream-side portion of the circulation conduit 12 to the recovery tank 20. The air contained in the recovery tank 20 is sucked by the suction opening of the air blower 18 through the conduit.

When passing through the steam heater 16, the air flow is heated to a given temperature by steam flowing in the heat exchangers 40. Thereafter, when the heated air flow passes through the humidifier 14, the heated air flow contacts the steam sprayed from the steam nozzles 24, thereby creating a moist air flow in the humidifier 14. This moist air flow is supplied from the humidifier 14 into the rotating cylinder 6, so that the moist air flow then circulates in the circulation path including the rotating cylinder 6.

In a case that the material is the aforesaid tobacco material, it is preferable that the moist air flow supplied to the rotating cylinder 6 have a temperature of from 40 to 80° C. and a relative humidity of from 80 to 95% close to a saturated vapor pressure.

When time required for the material to pass through the rotating cylinder 6, or residence time of the material, is set within the range of from 3 to 5 minutes, velocity of the moist air flow passing through the rotating cylinder 6 is selected from the range of from 0.1 to 0.3 m/s in accordance with a supply amount of the material fed into the rotating cylinder 6.

In order to control the temperature, relative humidity and velocity of the moist air flow, the temperature indicators 50, 56 and 62, the humidity indicators 52, 58 and 64, and the velocity indicators 54, 60 and 66 are electrically connected to a controller 72. The controller 72 is capable of receiving detection signals from the temperature, humidity and velocity indicators. At the same time, the controller 72 is electrically connected to the air blower 18 and the flow control valves 34 and 46.

Therefore, the controller 72 can control rotational speed of the air blower 18, which makes it possible to control the velocity of the moist air flow. Based on the inlet temperature $T_1$ of the moist air flow, which is indicated by the inlet temperature indicator 50, the controller 72 controls the opening of at least either one of the flow control valves 46, thereby controlling the temperature of the moist air flow.

If the opening of one of the flow control valves 46, which corresponds to the upstream-side heat exchanger 40*a* located in the steam heater 16, is maintained constant, the controller 72 can control only the opening of the other flow control valve 46, based on the inlet temperature $T_1$.

When the controller 72 receives the inlet temperature $T_1$ indicated by the inlet temperature indicator 50, the inlet humidity $H_1$ by the inlet humidity indicator 52, the inlet velocity $V_1$ by the inlet velocity indicator 54, the intermediate temperature $T_2$ by the intermediate temperature indicator 56, the intermediate humidity $H_2$ by the intermediate humidity indicator 58 and the intermediate velocity $V_2$ by the intermediate velocity indicator 60, based on these data, the controller 72 calculates amount of the steam to be sprayed from the steam nozzles 24 located in the humidifier 14.

Subsequently, based on the steam amount thus calculated, the controller 72 controls the opening of each flow control valve 34, thereby controlling the relative humidity of the moist air flow.

It is preferable that maximum opening of the two flow control valves 34 be different from each other. In this case, the controller 72 controls the opening of the flow control valves 34 individually, resulting in fine control of the relative humidity of the moist air flow.

Additionally, the circulation path for the moist air flow is provided with an outside air-introducing device (not shown) for ventilation.

Figure 2:
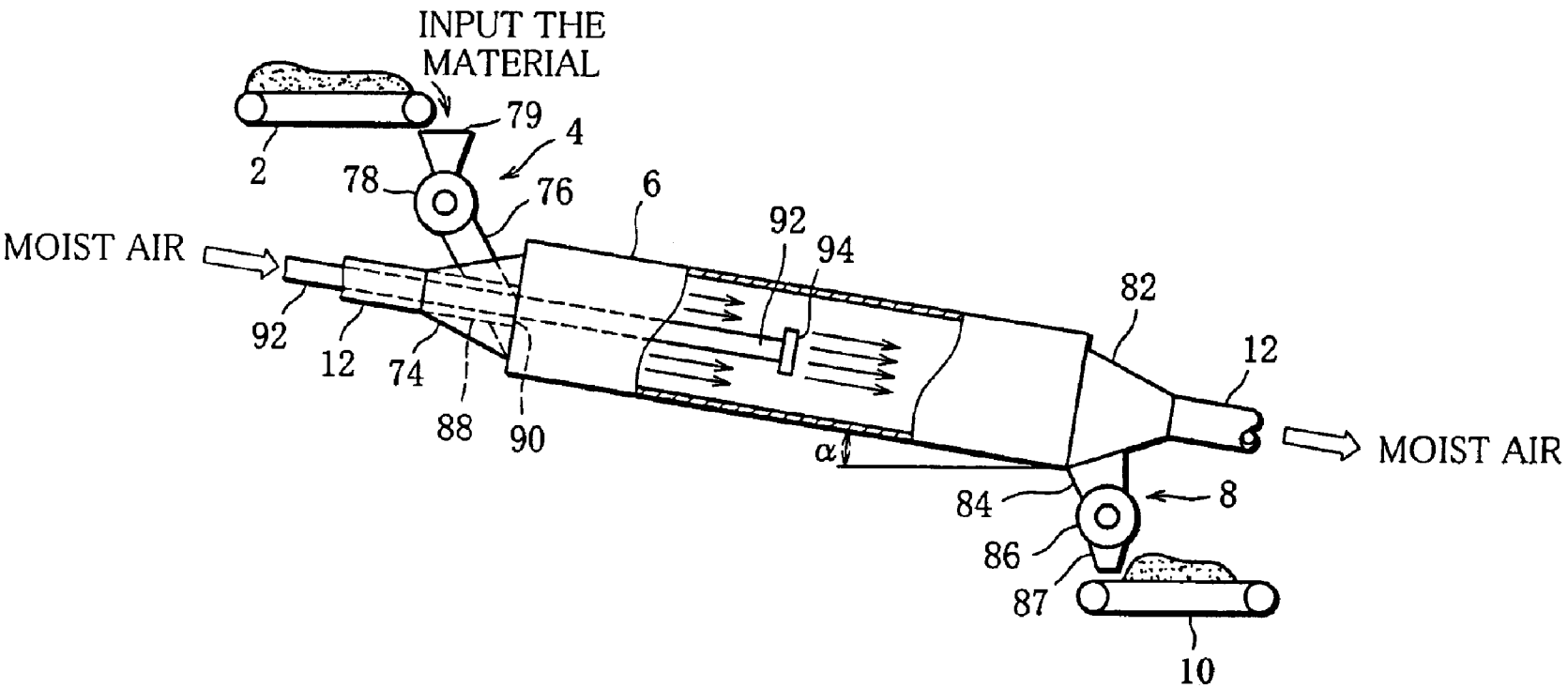
FIG. 2 is a view showing a rotating cylinder of FIG. 1, partially taken away.

As is apparent from FIG. 2, the rotating cylinder 6 is inclined such that the other end, that is, the end of the rotating cylinder 6 from which the material is discharged, faces downward, and an oblique angle with respect to a horizontal plane of the rotating cylinder 6 is indicated by a in FIG. 2. The rotating cylinder 6 is rotatably supported and rotated around an axis thereof in one direction.

The inlet 4 of the rotating cylinder 6 has an end cover 74 formed in a hollow conical shape, the end cover 74 having a small diameter end and a large diameter end. The large diameter end of the end cover 74 is airtightly connected to the one end of the rotating cylinder 6, that is, the end that receives the material from feed pipe 76, while allowing the rotation of the rotating cylinder 6. The upstream-side portion of the circulation conduit 12 is airtightly inserted into the end cover 74 from the small diameter end thereof, and an inserting portion 88 of the circulation conduit 12 has an air-supply opening 90 which is open at a center of the one end of the rotating cylinder 6. Thus, a first flow of moist air flow is blown out from the air-supply opening 90 of the circulation conduit 12 toward the other end of the rotating cylinder 6.

The end cover 74 has a feed pipe 76, which enters the inside of the end cover 74 from above the end cover 74. The feed pipe 76 has a lower end opened toward the one end of the rotating cylinder 6. Connected to an upper end of the feed pipe 76 is a rotary valve 78, which has an inlet hopper 79. The inlet hopper 79 is disposed right under a terminal end of the conveyer 2.

The rotary valve 78 has a rotor (not shown), and a plurality of pockets is formed in an outer peripheral surface of the rotor at regular intervals in a circumferential direction thereof. Each of the pockets receives the material delivered from the conveyer 2 through the inlet hopper 79 while the rotor rotates and then transfers the received material toward the feed pipe 76. Thereafter, when the pocket filled with the material coincides with the upper end of the feed pipe 76, the material is supplied from the pocket through the feed pipe 76 into the rotating cylinder 6.

Figure 3:
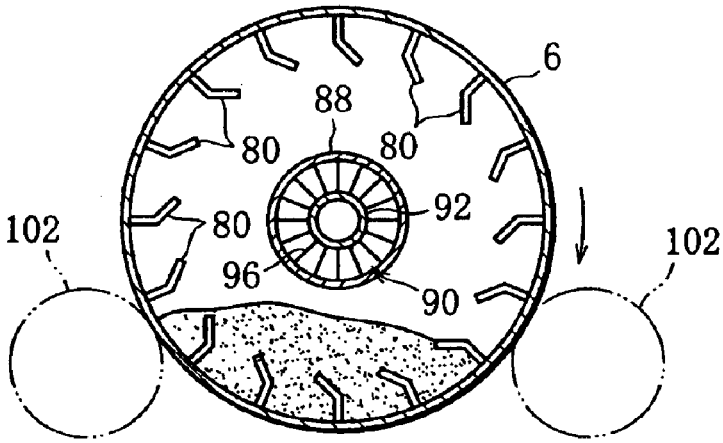
FIG. 3 is a cross-sectional view of the rotating cylinder of FIG. 2.

As illustrated in FIG. 3, fixed on an inner peripheral wall of the rotating cylinder 6 are a large number of stirring blades 80. The stirring blades 80 extend in the axial direction of the rotating cylinder 6 and are arranged at regular intervals in the circumferential direction of the rotating cylinder 6. Each stirring blade 80 has a tip end portion which is bent in a rotating direction (refer to an arrow) of the rotating cylinder 6.

When the rotating cylinder 6 is rotated, the material in the rotating cylinder 6 is scooped up by the stirring blades 80 so that the material is stirred. In accordance with the inclination of the rotating cylinder 6, the material is transferred toward the other end of the rotating cylinder 6.

The outlet 8 of the rotating cylinder 6 has an end cover 82 formed in a hollow conical shape, the end cover 82 being identical to the end cover 74 of the inlet 4. Therefore, a large diameter end of the end cover 82 is airtightly connected to the other end of the rotating cylinder 6 while allowing the rotation of the rotating cylinder 6. The downstream-side portion of the circulation conduit 12 is connected to a small diameter end of the end cover 82.

Connected to a lower portion of the end cover 82 is an outlet hopper 84, and a rotary valve 86 is connected to a lower end of the outlet hopper 84. The rotary valve 86 has the same construction as the rotary valve 78 and includes a discharge pipe 87 protruding toward a start end of the discharge conveyer 10.

When the material in the rotating cylinder 6 reaches the other end of the rotating cylinder 6, the material is supplied to the outlet hopper 84. The material in the outlet hopper 84 is taken out through the rotary valve 86 and discharged from the discharge pipe 87 onto the discharge conveyer 10 while the rotary valve 86 rotates.

Since the inlet 4 and the outlet 8 have the rotary valves 78 and 86, respectively, the cylinder chamber defined in the rotating cylinder 6 is maintained in a sealed state. This enables the material to be continuously supplied into and discharged from the rotating cylinder 6 while preventing the moist air from leaking out from the rotating cylinder 6. As a result, as will be described, a material moisture-controlling process is continuously carried out.

As illustrated in FIG. 2, an inner air-supply pipe 92 is concentrically disposed in the upstream-side portion of the circulation conduit 12, more particularly in a portion of the circulation conduit 12 which is located in the one end of the rotating cylinder 6. The inner air-supply pipe 92 projects from the inserting portion 88 of the circulation conduit 12. The inner air-supply pipe 92 is extended on the axis of the rotating cylinder 6 up to an intermediate position of the rotating cylinder 6 and has an intermediate air-supply opening 94 at a distal end thereof. Accordingly, a second flow of moist air is blown out also from the intermediate air-supply opening 94 of the inner air-supply pipe 92 into the rotating cylinder 6.

Figure 4:
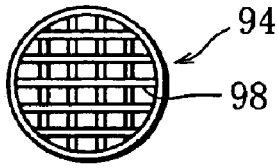
FIG. 4 is a front view of an intermediate air-supply opening of FIG. 3.

The air-supply opening 90 of the inserting portion 88 is formed in an annular shape by the inner air-supply pipe 92, and is provided with current plates 96 as illustrated in FIG. 3. Likewise, the intermediate air-supply opening 94 of the inner air-supply pipe 92 is also provided with current plates 98 as illustrated in FIG. 4. The current plates 96 and 98 rectify the moist air flow blown out from the air-supply opening 90 and the intermediate air-supply opening 94, respectively. This produces the moist air flow in the rotating cylinder 6, the moist air flow running along the axial direction of the rotating cylinder 6 as shown by an arrow of FIG. 2.

As shown by a double-dashed line in FIG. 3, a pair of driving rollers 102 is disposed outside the rotating cylinder 6 to rolling contact the rotating cylinder 6, and rotation of the driving rollers 102 rotates the rotating cylinder 6 in one direction.

A material moisture control method using the above moisture control apparatus will be described below.

The moist air flow is blown out from both the air-supply opening 90 and the intermediate air-supply opening 94 into the rotating cylinder 6. The moist air flow runs in the axial direction of the rotating cylinder 6, or in a forward direction identical to the material-transferring direction and is discharged into the downstream-side portion of the circulation conduit 12.

When the material is fed through the inlet 4 into the rotating cylinder 6 in the above-described state, the material is transferred toward the outlet 8 while being stirred by the stirring blades 80 when the rotating cylinder 6 is rotated.

In the material-transferring process, the material contacts the moist air flow in the rotating cylinder 6 to absorb moisture from the moist air flow.

The relative humidity of the moist air flow is set to be within the aforementioned range, so that the moist air flow does not include fine water droplets. Therefore, water droplets do not stick onto the surface of the material. Since the moist air flow runs in the material-transferring direction, and the material is stirred, the entire surface of the material is substantially exposed to the moist air in the material-transferring process. As a result, the material can uniformly absorb the moisture contained in the moist air from the entire surface thereof. When absorbing moisture, the material generates heat of absorption, which raises the temperature of the material. Thus, the material is evenly adjusted in moisture content and temperature through to the inside thereof. Subsequently, the material is discharged from the outlet 8 of the rotating cylinder 6.

Figure 5:
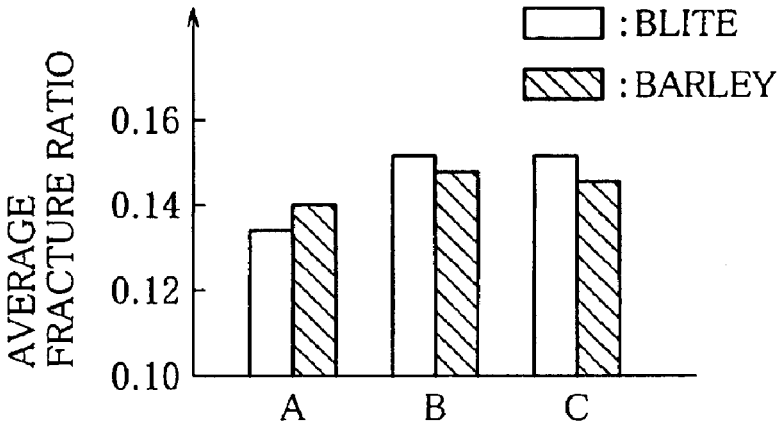
FIG. 5 is a graph showing a result of measurement of fracture ratios in materials with respect to the materials controlled in moisture by moisture control methods A, B and C.
Figure 6:
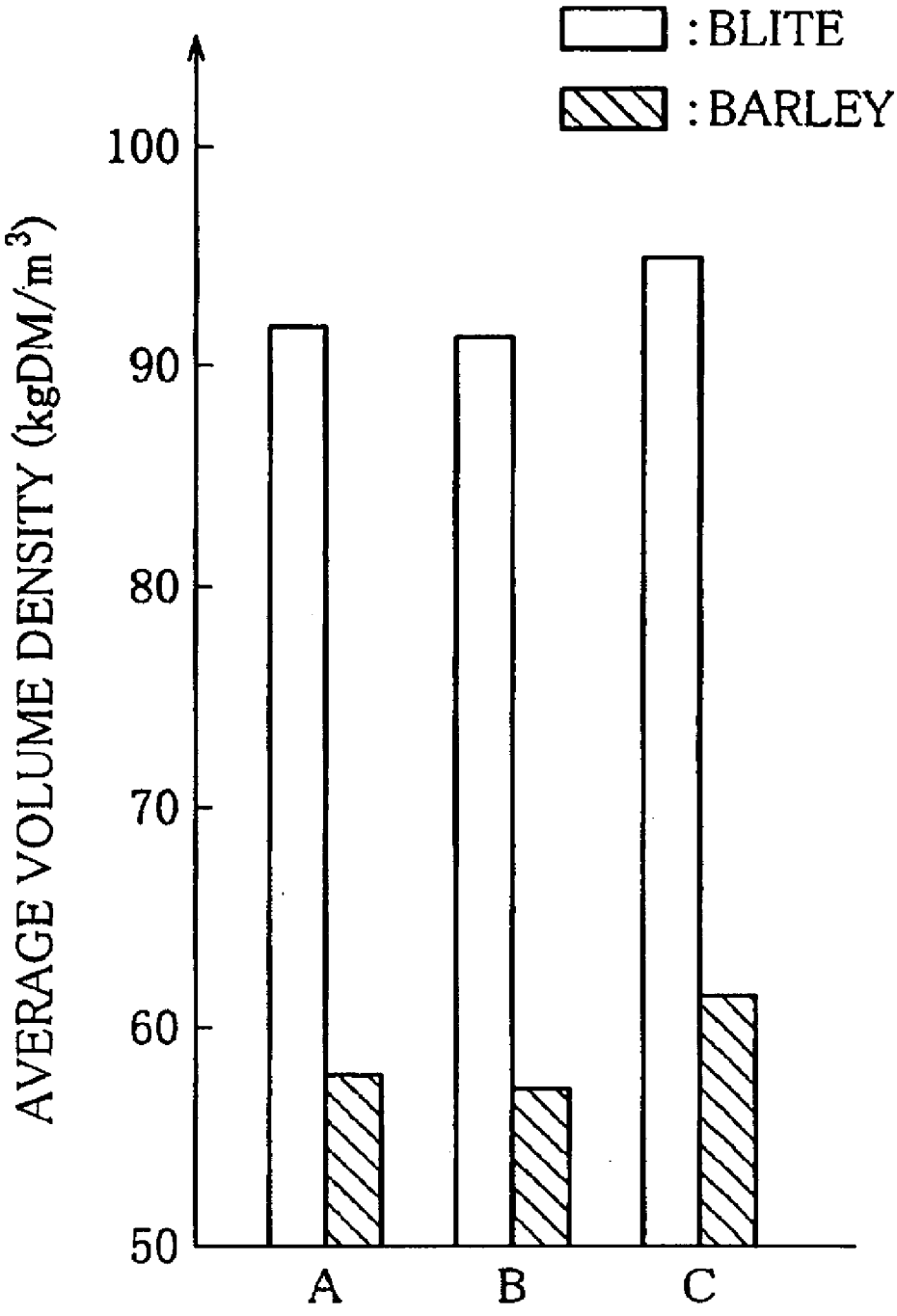
FIG. 6 is a graph showing a result of measurement of volume densities of materials with respect to the materials controlled in moisture by moisture control methods A, B and C.

FIGS. 5 and 6 show results of measurement in respect of average fracture ratios and average volume densities of the moisture-controlled material. In FIGS. 5 and 6, 'A' denotes the result of measurement of the material controlled in moisture by the method according to the above embodiment, and 'B' and 'C' represent the results of measurement of the materials controlled in moisture by other methods. Used as the materials are tobacco leaves of blite variety and barley variety, and the material before the moisture control had a moisture content of about 11%.

The average fracture ratio indicates proportion of material fragments included in the moisture-controlled material, and the fragment means one smaller than 6.7 mm both in length and width.

More specifically, in the moisture control method 'A' according to the embodiment, the supply amount of the material and the rotational speed of the rotating cylinder 6 are controlled such that residence quantity and residence time of the material in the rotating cylinder 6 are 21 kg DM (dry weight) and 3 minutes, respectively. In this case, the rotational speed of the rotating cylinder 6 is 10 rpm. In addition, the rotating cylinder 6 is 1.8 m in inner diameter and 1 m in length.

The moisture control method 'B' as a comparative example is different from the moisture control method 'A' only in residence time of the material in the rotating cylinder 6. In other words, in this moisture control method, the supply amount of the material and the rotational speed of the rotating cylinder 6 are controlled such that the residence time of the material is 15 minutes.

According to the moisture control method 'C' as a comparative example, water is directly sprayed from a spray nozzle on the material in the rotating cylinder 6 as well as the supply of the moist air flow into the rotating cylinder 6. In this case, the residence time of the material in the rotating cylinder 6 is 3 minutes just as in the case of the moisture control method 'A'. The water-supply amount to the material, however, is so controlled as to be identical to that in the case of the moisture control method 'B'.

As is obvious from FIG. 5, in respect of both the material of blite variety and that of barley variety, the moisture control method 'A' of the embodiment is low in average fracture ratios of the material, compared to the moisture control methods 'B' and 'C' as comparative examples, so that the material loss is decreased. This means that the moisture control method 'A' achieves more even moisture control of the material than the moisture control methods 'B' and 'C'.

The results of measurement shown in FIG. 6 indicate that the material moisture control using the moisture control method 'A' is achieved evenly through to the inside of the material. That is, the average volume density of the material in the moisture control method 'A' is substantially equal to that in the moisture control method 'B' but lower than that in the moisture control method 'C'. This means that according to the moisture control method 'A', the moisture absorption uniformly proceeds through to the inside of the material, and the moisture-controlled material is plump, compared to the moisture control method 'C'. Thus, the material controlled in moisture by the moisture control method 'A' of the embodiment has excellent permeability of aromatic additives, which enables a subsequent flavoring process to be effectively done.

Since water droplets do not stick onto the material as already mentioned, components of the material are not eluted into water droplets. To be more precise, in the case that the material is tobacco material, original aromatic components of the tobacco material are not eluted into water droplets, so that the tobacco material can maintain the aroma thereof even after being controlled in moisture.

Because the moist air flow has a temperature in the aforementioned range, the tobacco material is not overheated by the moist air flow, and the aroma of the tobacco material undergoes no heat deterioration.

According to the above-described moisture control apparatus, the rotating cylinder 6 comprises the air-supply opening 90 and the intermediate air-supply opening 94 in the inside thereof, and the air-supply opening 90 and the intermediate air-supply opening 94 are separated away from each other in the axial direction of the rotating cylinder 6. This makes it possible to create a uniform moist air flow in the rotating cylinder 6 without difficulty.

Because of the rotary valves 78 and 86 provided to the inlet 4 and the outlet 8 of the rotating cylinder 6, respectively, a leakage of the moist air flow is prevented, thereby reducing amount of consumption of the moist air.

The present invention is not limited to the above-described embodiment and may be modified in various ways.

Figure 7:
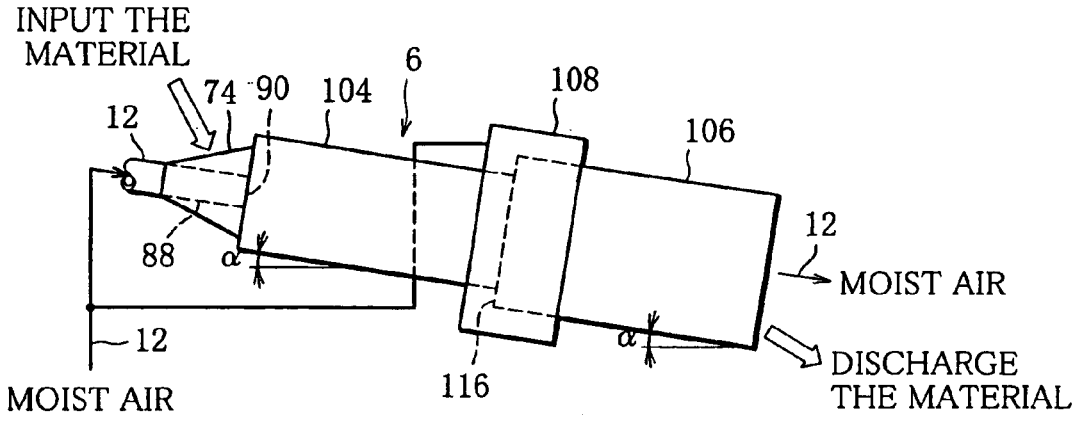
FIG. 7 is a view showing a rotating cylinder according to another embodiment.

For instance, FIG. 7 shows a split-type rotating cylinder 6. The rotating cylinder 6 has an upstream-side cylinder portion 104 and a downstream-side cylinder portion 106, the cylinder portions 104 and 106 being rotated in sync with each other. The downstream-side cylinder portion 106 has a larger diameter than the upstream-side cylinder portion 104. A boundary area between the upstream-side and downstream-side cylinder portions 104 and 106 is covered with a fixed ring cover 108.

Figure 8:
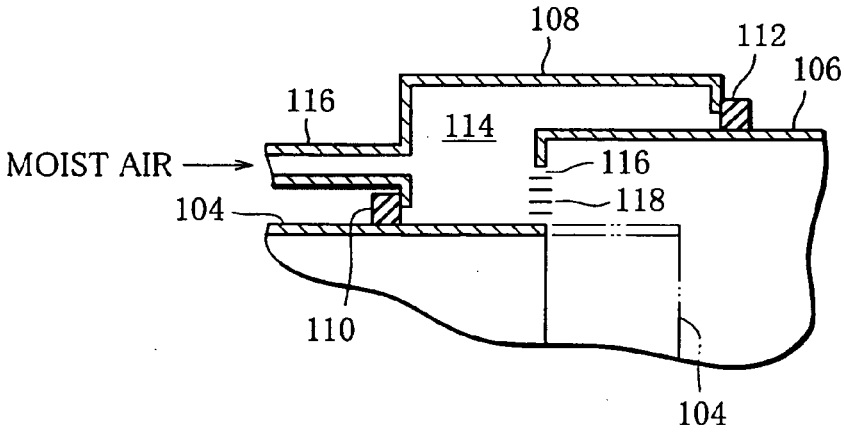
FIG. 8 is an enlarged cross-sectional view of a part of the rotating cylinder of FIG. 7.

As illustrated in FIG. 8, seal rings 110 and 112 are arranged in between the ring cover 108 and the upstream-side cylinder portion 104 and between the ring cover 108 and the downstream-side cylinder portion 106, respectively. Therefore, the ring cover 108 and outer peripheral surfaces of the upstream-side and downstream-side cylinder portions 104 and 106 define a chamber 114 in consort. Extended from the chamber 114 is a connecting pipe 116, which is connected to the upstream-side portion of the circulation conduit 12.

In the chamber 114, there is formed an annular intermediate air-supply opening 116 in between the upstream-side cylinder portion 104 and the downstream-side cylinder portion 106. The intermediate air-supply opening 116 makes the chamber 114 communicate with the inside of the downstream-side cylinder portion 106. The intermediate air-supply opening 116 is also provided with annular current plates 118.

This modified embodiment does not include the aforementioned inner air-supply pipe 92. Therefore in this case, a circular current plate is fixed to the air-supply opening 90 of the inserting portion 88 in the circulation conduit 12.

Also in the split-type rotating cylinder 6, the moist air flow is blown out both from the air-supply opening 90 and from the intermediate air-supply opening 116 into the rotating cylinder 6, and the moist air flow proceeding from the inlet 4 toward the outlet 8 is similarly produced in the rotating cylinder 6.

The air-supply opening 90 blows out a first moist air flow toward a central portion of the upstream-side cylinder portion 104, and the intermediate air-supply opening 116 discharges a second moist air flow along an outer peripheral portion of the downstream-side cylinder portion 106. As a result, the moist air flow runs uniformly in a cross-sectional region of the rotating cylinder 6, thereby further improving effects of the material moisture control.

Referring to FIG. 8, as shown by a double-dashed line, the upstream-side and downstream-side cylinder portions 104 and 106 may overlap each other. Moreover, the rotating cylinder 6 is not necessarily provided with two air-supply openings but may be provided with three or more.

Moreover, the flowing direction of the moist air is not limited to the forward direction with respect to the material-transferring direction but may be an inverse direction to the transferring direction.

In the embodiments, the moist air flow, which is adjusted to have the given temperature and the given relative humidity, is supplied into the rotating cylinder 6. The controller 72 may control the temperature, relative humidity and velocity of the moist air flow to bring the percentage of water content of the moisture-controlled material into agreement with a target value. Specifically, based on the supply amount of the material, and the inlet temperature $T_1$, inlet humidity $H_1$, inlet velocity $V_1$, outlet temperature $T_3$, outlet humidity $H_3$ and outlet velocity $V_3$ of the moist air flow, etc., the controller 72 calculates the percentage of water content of the moisture-controlled material and performs feedback control on the inlet temperature $T_1$, inlet humidity $H_1$ and inlet velocity $V_1$ of the moist air flow supplied into the rotating cylinder 6 such that the calculated percentage of water content becomes equal to the target value.

It would be obvious that the moisture control method and apparatus of the present invention are applicable to the moisture control of food product material besides tobacco material.

What is claimed is:

1. A method of controlling moisture of material, said method comprising the steps of:

transferring material along a given transfer path while stirring the material; and causing first and second moist air flows, which are heated to a given temperature and have relative humidity close to a saturated vapor pressure, to flow along the transfer path, to thereby bring the material into contact with the first and second moist air flows in a manner in a manner such that the first moist air flow moves along a whole length of the transfer path and the second moist air flow moves from an intermediate position between the inlet and outlet of the transfer path to the outlet of the transfer path.

2. The method according to claim 1, wherein:

the first and second moist air flows have a relative humidity of from 80 to 95%.

3. The method according to claim 2, wherein:

the material is tobacco material.

4. The method according to claim 3, wherein:

the first and second moist air flows have a heating temperature of from 40 to 80° C.

5. The method according to claim 1, wherein:

the first and second moist air flows circulate through the transfer path.

6. An apparatus for controlling moisture of material, said apparatus comprising:

a hollow rotating cylinder having an inlet for the material at one end thereof and an outlet for the material at the other end thereof and transferring the material supplied through the inlet to the outlet while stirring the material when said rotating cylinder is rotated; and a feeding device for supplying first and second flows of moist air flows, which are heated to a given temperature and close to a saturated vapor pressure, into said rotating cylinder to bring the material into contact with the first and second moist air flows, said feeding device having a first air-supply opening for the first moist air flow, located at the one end of said rotating cylinder, an intermediate air-supply opening for the second moist air flow, located downstream of the air-supply opening in said rotating cylinder, and a discharge opening located at the other end of said rotating cylinder, the feeding device causing the first and second moist air flows to move within said rotating cylinder from the first air-supply opening and the intermediate air-supply opening, respectively, toward the discharge opening.

7. The apparatus according to claim 6, wherein:

said feeding device further includes a circulation conduit extended outside said rotating cylinder to connect the first air-supply opening and the intermediate air-supply opening with the discharge opening;

the inlet and the outlet include respective rotary valves;

the rotary valves each allow the material to be either supplied into or discharged from said rotating cylinder and prevent the moist air flow from leaking out from the inlet and said outlet.

8. The apparatus according to claim 7, wherein:

the circulation system further includes an air blower, a heater and a humidifier arranged in the circulation conduit in the order named from the discharge opening side;

the air blower produces an air flow moving toward said rotating cylinder;

the heater heats the air flow to a given temperature; and the humidifier moistens said heated air flow.

9. The apparatus according to claim 8, wherein:

the circulation system further includes control means for controlling operation of the air blower, heater and humidifier.

10. The apparatus according to claim 6, wherein:

the intermediate air-supply opening is located on the axis of said rotating cylinder.

11. The apparatus according to claim 6, wherein:

the intermediate air-supply opening is formed into an annulus extending along a circumferential wall of said rotating cylinder.

12. The apparatus according to claim 11, wherein:

said rotating cylinder comprises an upstream-side cylinder portion including the inlet and a downstream-side cylinder portion including the outlet and having a larger diameter than the upstream-side cylinder; and the intermediate air-supply opening is defined in between an outer peripheral surface of said upstream-side cylinder portion and an inner peripheral surface of said downstream-side cylinder portion.

* * * * *